US006553616B2

(12) United States Patent
Johnson

(10) Patent No.: US 6,553,616 B2
(45) Date of Patent: Apr. 29, 2003

(54) CARPET THRESHOLD

(75) Inventor: Timothy S. Johnson, Calgary (CA)

(73) Assignee: Duramax, Inc., Middlefield, OH (US)

( * ) Notice: Subject to any disclaimer, the term of this patent is extended or adjusted under 35 U.S.C. 154(b) by 0 days.

(21) Appl. No.: 10/001,704

(22) Filed: Oct. 25, 2001

(65) Prior Publication Data

US 2002/0083553 A1 Jul. 4, 2002

Related U.S. Application Data

(60) Provisional application No. 60/243,074, filed on Oct. 25, 2000.

(51) Int. Cl.[7] ..... A47G 27/04
(52) U.S. Cl. ..... 16/16
(58) Field of Search ..... 16/16, 10, 4, 1, 16/8, 17.1

(56) References Cited

U.S. PATENT DOCUMENTS 2,796,624 A * 6/1957 Speer ..... 16/16
3,696,461 A * 10/1972 Kelly ..... 16/16
4,156,300 A * 5/1979 Jarjavail et al. ..... 16/16
4,913,576 A * 4/1990 Grant, Jr. ..... 16/16

* cited by examiner

*Primary Examiner*—Chuck Mah
(74) *Attorney, Agent, or Firm*—D. Peter Hochberg; Katherine R. Vieyra; Sean Mellino

(57) ABSTRACT

A carpet tack strip threshold for installation in the threshold area of double doorways of the type commonly found in hotels and motels and the like. The carpet tack strip threshold has a wide central portion which separates opposing cavities designed for receiving and tucking the edges of the carpet from adjoining rooms. Carpet tack strips nailed down through opposing receiving wings secure the carpet along the carpet tack strip threshold. The carpet tack strip threshold provides a smooth walkway across the threshold between adjoining rooms connected by the double doors in hotels and motels.

10 Claims, 5 Drawing Sheets

CARPET THRESHOLD

This application claims the benefit of provisional application No. 60/243,024 filed Oct. 25, 2000.

BACKGROUND OF THE INVENTION

1. Field of the Invention

The present invention relates generally to a flooring adapter device, and more particularly, to an improved stretch-in carpet threshold between the double doors in adjoining rooms in hotel/motel facilities.

2. Description of the Prior Art

The prior art consists of carpet transition devices and methods which require the use of several individual components to hold the edges of carpets from adjoining rooms together through a doorway. The individual components result in change of level differences which could create a tripping hazard.

The present invention is an improvement over the prior art because it is a much simpler design that avoids the multipiece assembly. It provides a smooth transition of carpets over the threshold of double doors from adjoining rooms in hotels and motels. The edges of the carpet are stretched and inserted into a receiving cavity formed in each of the opposing sides of the threshold. A carpet tack strip is nailed to the floor over opposing receiving wings of the threshold for receiving and holding the edge of the carpet. Since both edges of the carpet are tucked into the opposing receiving cavities underneath a wide central portion of the threshold, a smooth transition from one carpet to the other is accomplished. The threshold also serves to seal the gap between the bottom of the doors and floor. Noise, odor, light and drafts are thus prevented from traveling from room to room through the gap underneath the double doors.

SUMMARY OF THE INVENTION

It is an object of the invention to provide a stretch-in carpet threshold for installation between the double doors in adjoining rooms in hotel and motel facilities.

It is another object of the invention to provide a carpet threshold that is used with a carpet tack strip.

It is another object of the invention to provide a carpet threshold with receiving cavities for receiving and tucking the edges of the carpet from adjoining rooms.

It is another object of the invention to provide a carpet threshold with receiving wings for receiving a carpet tack strip for gripping the edges of the carpet from adjoining rooms.

It is another object of the invention to provide a carpet threshold that can be glued to wood and concrete subfloors.

It is another object of the invention to provide a carpet threshold that can seal the gap between the door and the floor to prevent noise, odors, light and drafts from traveling between adjoining hotel or motel rooms.

It is another object of the invention to provide a carpet threshold that is simple to use and has a small number of pieces.

The foregoing and other objects of the invention are achieved by a carpet tack strip threshold made from vinyl or rubber for receiving the ends of the carpet from adjoining rooms in a hotel or motel. The carpet is stretched onto tacks from a carpet tack strip nailed to the subflooring over a receiving wing portion of the threshold. The ends of the carpet are inserted and tucked into receiving cavities located on opposing sides of the threshold. A central strip on the threshold divides the carpet from adjoining rooms while providing a smooth transition between adjoining carpets. The threshold is precut to a standard door width, or cut to the width of the doorway, and glued to the wood or concrete subfloor before the carpet in adjoining rooms is installed. Carpet tack strips are then cut to length and nailed to the subfloor over opposing receiving wing portions of the threshold. The carpet installer then stretches the edge of the carpet onto the pins of the tack strip. A special tucking tool or the handle of a hammer is used to secure the carpet to the tack strip and tuck the edges of each carpet into the receiving cavities.

DESCRIPTION OF THE PREFERRED EMBODIMENT

Figure 1:
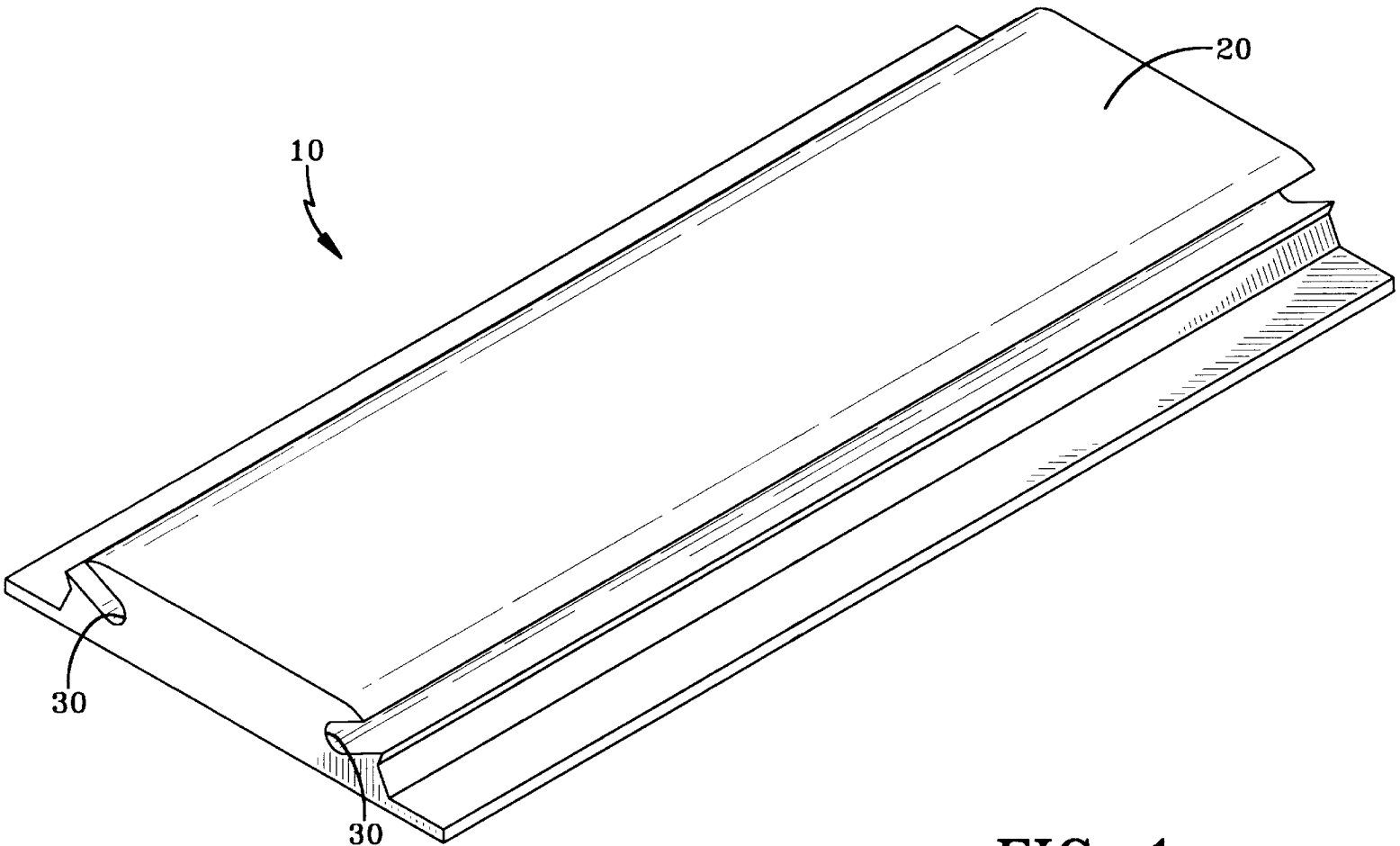
FIG. 1 is a front perspective view of the preferred embodiment of a carpet tack strip threshold.

Referring first to FIG. 1, shown is a preferred aspect of a carpet tack strip threshold 10 for use in joining the edges of the carpeting in the doorway double doors of adjoining rooms in hotels and motels. Adjoining rooms so equipped have a double set of doors which require the occupant from each room to open the respective door in order to open a passage between the adjoining rooms. In certain situations this may be desirable, such as a family traveling together including parents who want to supervise their children staying in the adjoining room. The double door configuration creates an extra wide threshold between the floor surface in adjoining rooms. This threshold area may be carpeted, tiled, or covered with a floor covering to match one or both of the adjoining rooms. However, this is unsatisfactory for a couple of reasons. First, a gap is often left underneath the double doors where drafts, light, odors, such as tobacco smoke, and noise may be carried between the adjoining rooms. In a hotel/motel situation, this gap is highly undesirable since occupants in adjoining rooms require complete privacy from each other. The carpet threshold 10 acts to seal the gap beneath the double doors preventing drafts, light, odors, and noise from traveling between adjoining rooms. The central portion 20 of the carpet threshold 10 has an upper surface 20*a* which extends laterally outward from an imaginary longitudinally extending central plane. Upper surface 20*a* is generally flat and smooth. Central portion 20 is extra wide to span the distance between the double doors enabling the carpet threshold 10 to extend the entire width of the doorway. The outer edges of central portion 20 taper slightly downward for guiding the bottom edges of the double doors onto the upper surface 20*a* of central portion 20 as the doors are put in the shut position. Second, carpet edges that are taped together or glued across the doorway threshold tend to fray and the joint tends to weaken. This problem is eliminated because opposing receiving cavities 30, located on opposite sides of central portion 20 and extending from the outer edges of the central portion, receive the carpet edges and prevent fraying.

Figure 2:
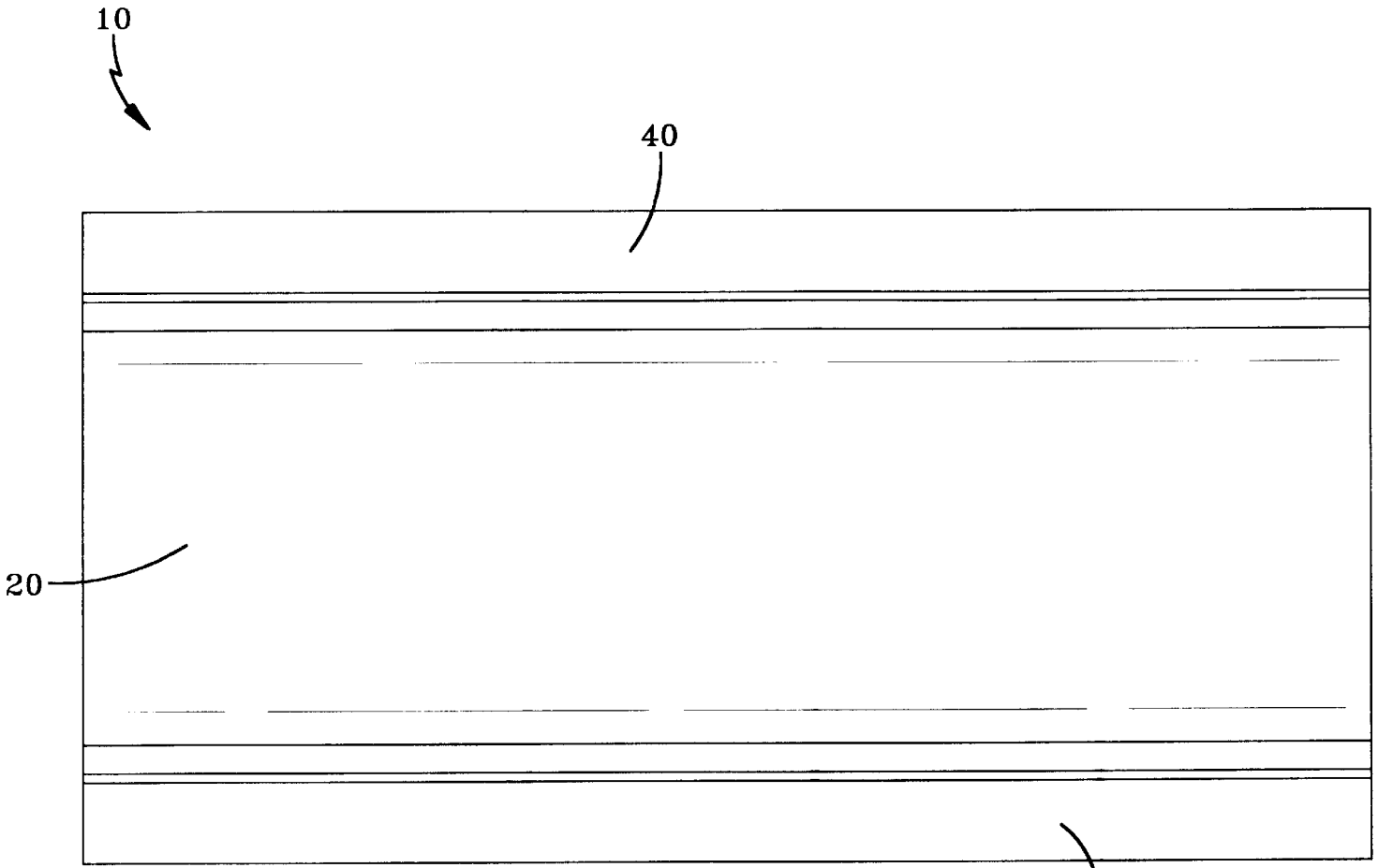
FIG. 2 is a top view thereof.

Referring now to FIG. 2, receiving wings 40 extend outwardly relative to the central plane and laterally from opposite sides of the lower portions of the central portion 20 for receiving a carpet tack strip and a portion of the carpet pad beneath the carpet. The width of receiving wings 40 may vary according to application but must at least be of sufficient width to receive the carpet tack strip and the carpet pad. A carpet tack strip is a piece of wood typically measuring ¼" thick by 1" wide and usually is manufactured and sold in four foot lengths. Carpet tack strips could be packaged with the carpet tack strip threshold 10 and cut to length at the installation site. The carpet tack strip is comprised of numerous carpet pins set typically at an angle of about 60 degrees and extending from the surface of the tack strip a distance of advantageously 7/32". In addition to the carpet pins, the carpet tack strip typically has ⅝" concrete nails or 1" wood floor nails equally spaced across the tack strip length to secure the tack strip to the subfloor. A carpet tack strip can be installed on each receiving wing 40.

Figure 3:
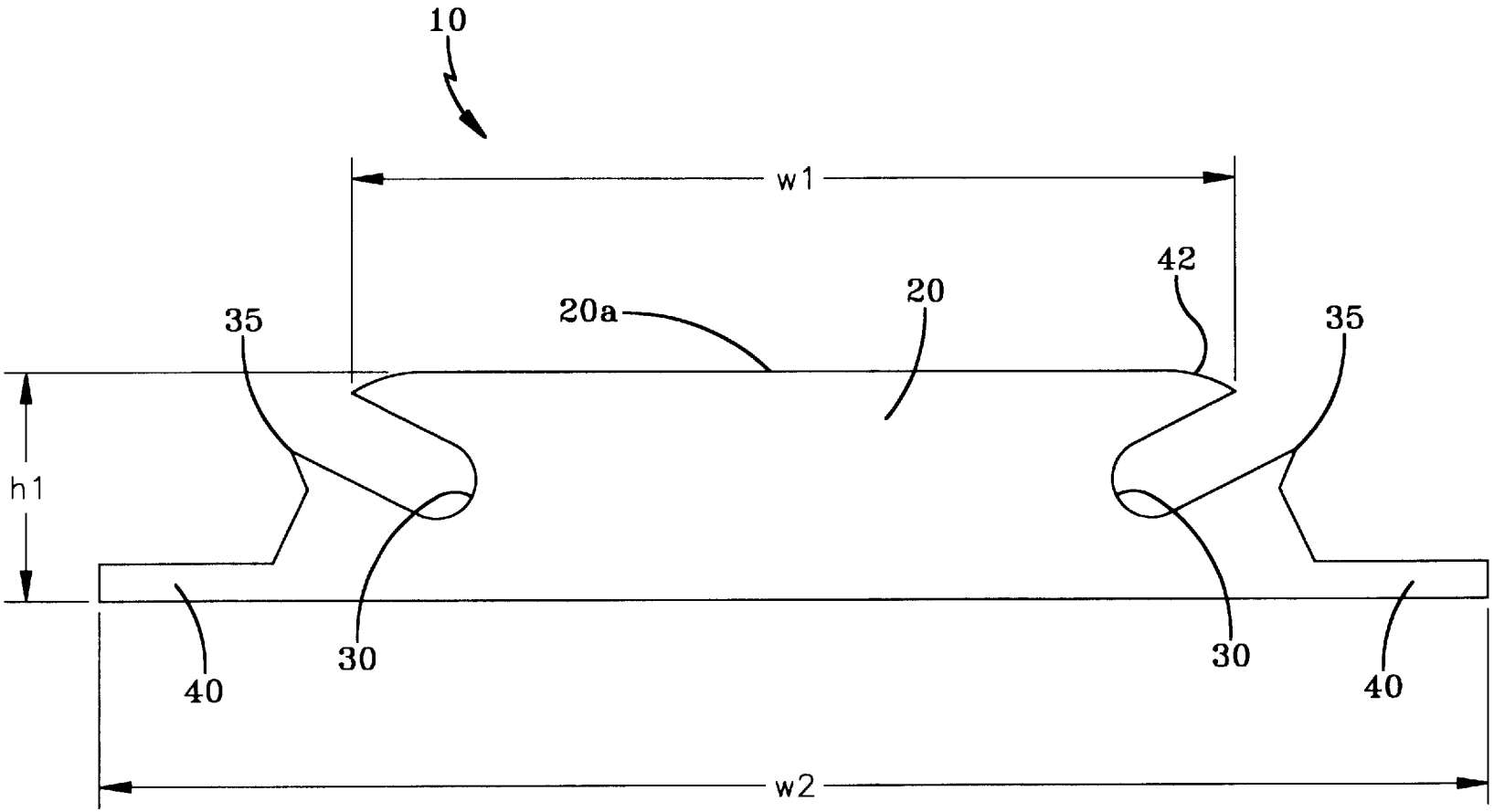
FIG. 3 is a side view thereof.

FIG. 3 shows a side view of a carpet tack strip threshold 10 showing receiving cavities 30 on opposing sides of central portion 20. Both of cavities 30 begin at the outer edge of central portion 20, curve in a semi-circular fashion, incline downwardly, extending into central portion 20 toward the central plane, and terminate in the central portion 20 at ridge 35. Ridge 35 is slightly higher than the bottom of cavity 30. The outer edges 42 of the upper portion of central portion 20 taper slightly downwardly so that the bottom edges of the double doors will be guided onto the upper surface 20*a* of central portion 20 as the doors are put in the shut position. The width and thickness of carpet threshold 10 and central portion 20 are a matter of design choice that can be varied to fit a particular application. Since the majority of double door jambs in hotel and motel applications have uniform dimensions, it is advantageous to manufacture carpet tack strip threshold 10 with the dimensions listed herein. For example, in a preferred embodiment of the invention, the width, designated as w1, of central portion 20 from opposing lateral edges could be 5.5". In a second preferred embodiment of the invention, the width w1 of central portion 20 from opposing lateral edges could be 1.75". The overall width w2 of carpet tack strip threshold 10 from the opposing lateral edges of the receiving wings 40 could be 7.8". In a second preferred embodiment of the invention, the overall width w2 of carpet tack strip threshold 10 could be 4.05". In both preferred embodiments, the thickness of carpet tack strip threshold 10, designated as h1, could be 0.5".

Figure 4:
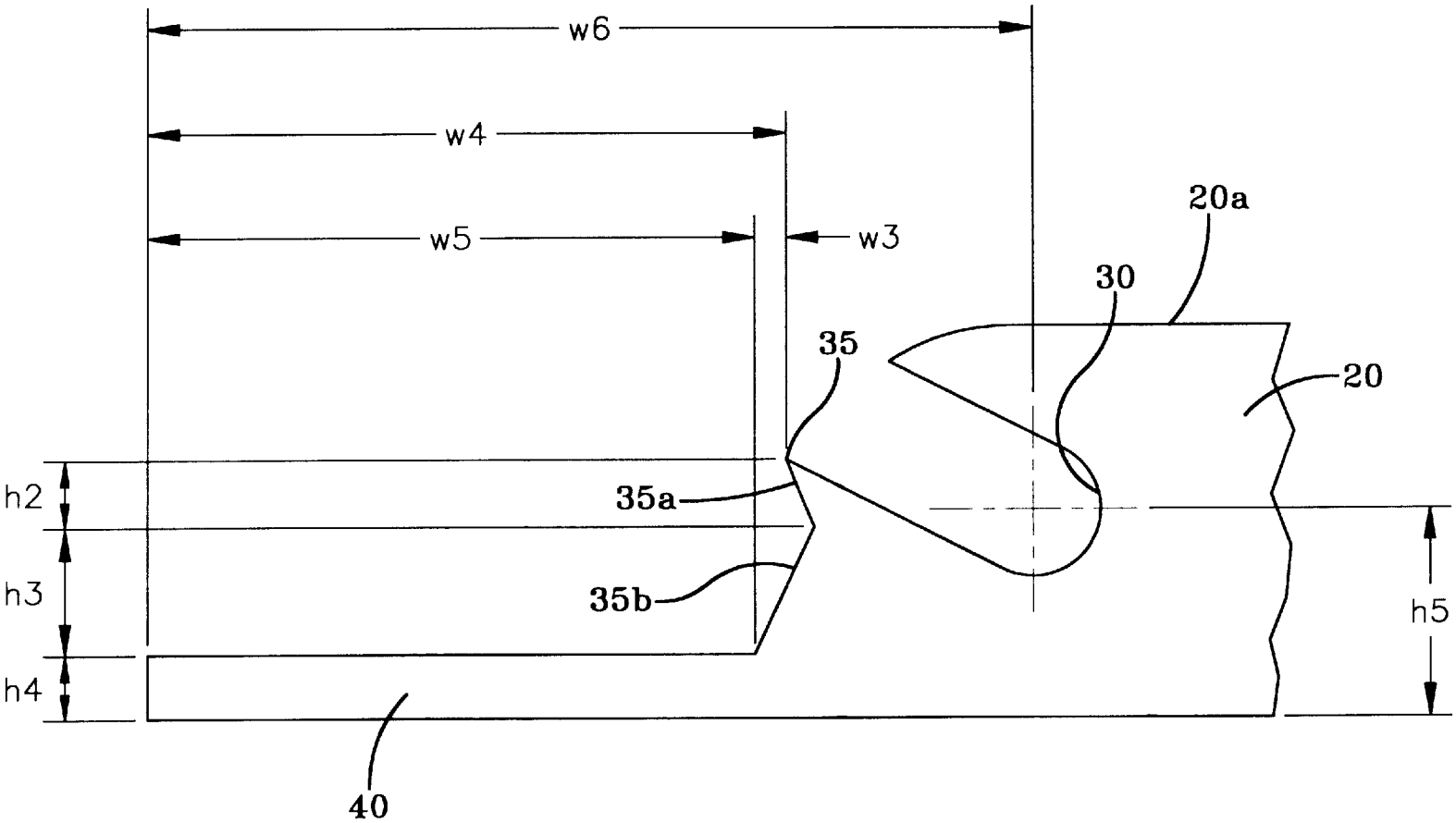
FIG. 4 is a partial detailed side view of a carpet tack strip threshold showing the detail of the carpet receiver opening and the receiver wing.

Referring now to FIG. 4, ridge 35 has two outwardly tapering sections extending downwardly from the top of ridge 35 before terminating at receiving wing 40. The first tapering section or upper ridge 35*a* is very steep inclining from top to bottom towards an imaginary longitudinal central plane along the longitudinal axis of threshold 10, and has a small height as measured parallel to the vertical. The second tapering section or lower ridge 35*b* is less steep than first tapering section 35*a* and has a height larger than first tapering section 35*a* as measured parallel to the vertical, and is inclined in the opposite direction from section 35*a*. For example, in a preferred embodiment of the invention, the height of first tapering section 35*a*, designated as h2, could be 0.06", and the height of second tapering section 35*b*, designated as h3, could be 0.135". The width of ridge 35, designated as w3, could be 0.078" while the horizontal distance from the top of ridge 35 to the outer edge of receiving wing 40, designated as w4, could be 0.910". The width w5 of receiving wing 40 could be 0.832" while the thickness h4 of receiving wing 40 could be 0.05". The radius of curvature of cavity 30 could be 0.142" while the vertical height of the geometric center of cavity 30, designated as h5, is 0.269". The distance from the geometric center of cavity 30 to the outer edge of the receiving wing 40, designated as w6, can be 1.357". In a second preferred embodiment of the invention, the height of first tapering section 35*a*, designated as h2, could be 0.06", and the height of second tapering section 35*b*, designated as h3, could be 0.135". The width of ridge 35, designated as w3, could be 0.078" while the horizontal distance from the top of ridge 35 to the outer edge of receiving wing 40, designated as w4, could be 0.910". The width w5 of receiving wing 40 could be 0.832" while the thickness h4 of receiving wing 40 could be 0.05". The radius of curvature of cavity 30 could be 0.142" while the vertical height of the geometric center of cavity 30, designated as h5, is 0.269". The distance from the geometric center of cavity 30 to the outer edge of the receiving wing 40, designated as w6, can be 1.357".

Figure 5:
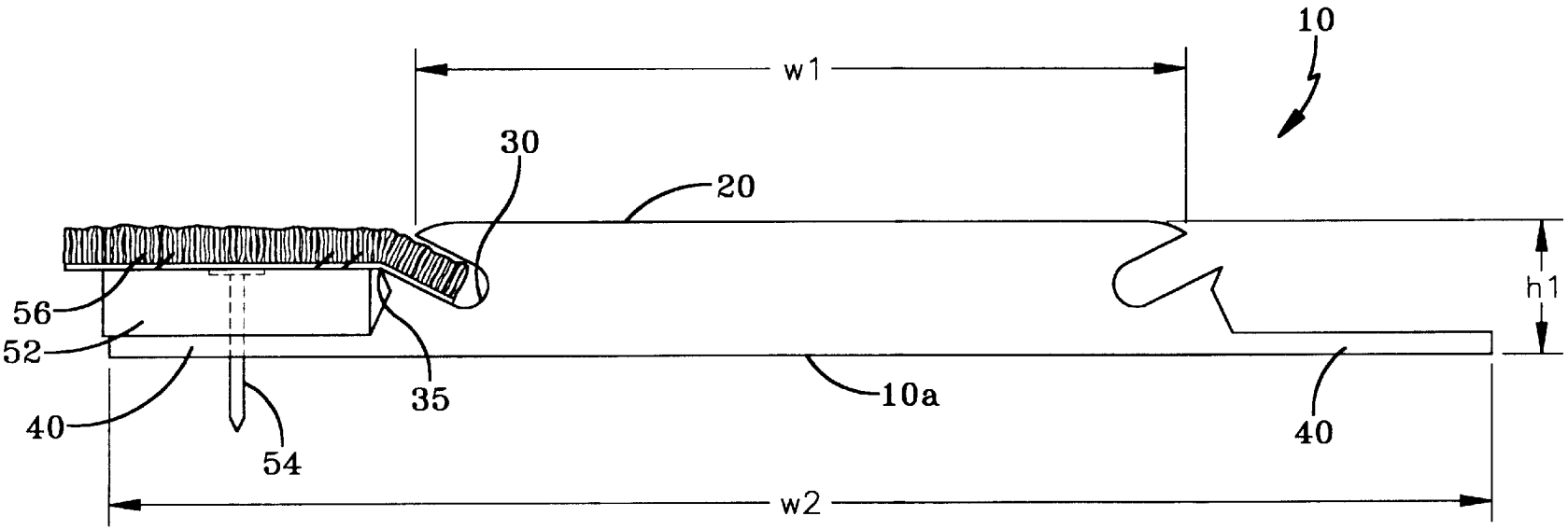
FIG. 5 is a side view of a carpet tack strip threshold shown in use with one carpet installed over the receiver wing and inserted into the carpet receiver opening and a tack strip installed over the receiver wing for securing the carpet thereto.

Referring now to FIG. 5, carpet tack strip threshold 10 is shown in the intended use with the edge of the carpet inserted into receiving cavity 30. The carpet tack strip threshold 10 is installed on the substrate within the confines of a double door jamb. An industry approved adhesive is spread on the bottom surface 10*a* of a carpet tack strip threshold 10 and then carpet tack strip threshold 10 is firmly pressed onto the substrate. After the adhesive has had time to set, carpet tack strips 52 (only shown on the left side of the figure) are installed onto each of the opposing receiving wings 40 by driving the ⅝ concrete nails or 1" wood floor nails (the nails are identified by the numeral 54) through the receiving wings 40 into the concrete or wood substrate beneath. The tack strips 52 are installed so that the angled carpet pins 56 are facing inwardly toward the imaginary plane extending through the longitudinal axis of carpet tack strip threshold 10. The upper surface of the carpet tack strips should now be coplanar or nearly so with the horizontal plane of the highest point of ridge 35. The carpet installer can now install the pad underlayment in each of the adjoining rooms flush to the edge of the carpet tack strips. The upper surface of the pad underlayment should now also be coplanar with the upper surface of the carpet tack strip and the horizontal plane of the top edge of ridge 35. Carpet from the adjoining room can now be installed on a continuous, even surface extending from the pad underlayment over the carpet tack strip and into receiving cavity 30. The carpet is installed by using conventional carpet stretching tools to stretch the carpet onto the carpet pins of the tack strip. The inwardly facing pins will grab the carpet and hold it firmly in place. The carpet must be measured carefully to allow for the stretching while at the same time leaving enough of the carpet edge extending past the position of the carpet pins to be snugly tucked into receiving cavity 30. As the carpet is stretched onto the carpet pins, the edge of the carpet is inserted into receiving cavity 30. Once the carpet is seated on the carpet pins, the edge of the carpet is firmly tucked into cavity 30 underneath the outer edges of central portion 20. The carpet may be secured to the carpet pins and tucked into cavity 30 using a special tucking tool or the handle of a hammer. The process is repeated for the carpeting from the adjoining room for the opposing side of carpet tack strip threshold strip 10. Once carpets from the adjoining rooms are installed and the edges are snug in the respective receiving cavities 30, the carpet tack strip threshold 10 provides a smooth, low profile walking surface for traversing the doorway from one room to another. The carpet tack strip threshold has a walking surface area which exceeds federal requirements of 0.5 for a slip-resistant surface when tested in accordance with ASTMD-2047, James Machine Coefficient of Friction, and is structurally stable.

The invention has been described in detail, with particular emphasis being placed on the preferred embodiments thereof, but variations and modifications may occur to those skilled in the art to which the invention pertains.

What is claimed is:

1. A carpet threshold for double doors jambs, said threshold comprising:

a central portion having an upper surface extending laterally outwardly from an imaginary longitudinally extending central plane, and downwardly extending outer edges on opposite sides of the plane for guiding the double doors onto the upper surface of said central portion as the double doors are put in the shut position;

receiving cavities on opposing sides of the central plane extending from said outer edges, said cavities being inclined downwardly and extending into said central portion toward the central plane and terminating in said central portion, said cavities having upper and lower edges on the outer surface of said threshold;

ridges extending downwardly of the lower edges of said cavities and terminating in lower portion; and receiving wings extending outwardly relative to the central plane from the lower portions of said ridges.

2. A carpet threshold according to claim 1, wherein:

said ridges each comprise an upper ridge extending downwardly from the lower edge of said cavity and being inclined from top to bottom towards the central plane, and a lower ridge extending downwardly from said upper ridge towards said receiving wing and inclined oppositely from said upper ridge.

3. A carpet threshold according to claim 1 and further including a carpet tack strip on each of said receiving wings for supporting carpeting having an edge for insertion into said cavity.

4. A carpet threshold according to claim 1, wherein:

the upper surface of said central portion is generally flat and smooth.

5. A carpet threshold according to claim 1, wherein:

the distance between opposing outer edges of said central portion is between 5 and 6 inches, the thickness of the carpet threshold is between 0.25 and 0.75 inches, the distance between the opposing outer edges of the receiving wings is between 7 and 8.5 inches, the height of the first tapering section is between 0.01 and 0.1 inches, the height of the second tapering section is between 0.1 and 0.2 inches, the horizontal distance from the top of the ridge to the inner edge of the receiving wing is between 0.05 and 0.10 inches, the horizontal distance from the top of the ridge to the outer edge of the receiving wing is between 0.75 and 1.00 inches, the horizontal distance from inner edge of the receiving wing to the outer edge of the receiving wing is between 0.7 and 1.0 inches, the thickness of the receiving wing is between 0.02 and 0.07 inches, the radius of curvature of the cavity is between 0.1 and 0.2 inches, the vertical height of the geometric center of the cavity is between 0.2 and 0.3 inches.

6. A carpet threshold according to claim 1, wherein:

the distance between opposing outer edges of said central portion is 1.75", the thickness of the carpet threshold is 0.5", the distance between the opposing outer edges of the receiving wings is 4.05", the height of the first tapering section is 0.06", the height of the second tapering section is 0.135", the horizontal distance from the top of the ridge to the inner edge of the receiving wing is 0.078", the horizontal distance from the top of the ridge to the outer edge of the receiving wing is 0.910", the horizontal distance from inner edge of the receiving wing to the outer edge of the receiving wing is 0.832", the thickness of the receiving wing is 0.05", the radius of curvature of the cavity is 0.142", the vertical height of the geometric center of the cavity is 0.269".

7. A carpet threshold according to claim 1, wherein:

said central portion is made from vinyl.

8. A carpet threshold according to claim 1, wherein:

said central portion is made from rubber.

9. A carpet threshold according to claim 1, wherein:

said central portion, said cavities and said ridge are made from vinyl.

10. A carpet threshold according to claim 1, wherein:

said central portion, said cavities and said ridge are made from rubber.

* * * * *

UNITED STATES PATENT AND TRADEMARK OFFICE

CERTIFICATE OF CORRECTION

PATENT NO. : 6,553,616 B2
DATED : April 29, 2003
INVENTOR(S) : Timothy S. Johnson It is certified that error appears in the above-identified patent and that said Letters Patent is hereby corrected as shown below:

Column 5,
Line 11, delete "1" and insert -- 2 --; line 52, delete "first tapering section" and insert -- upper ridge --; line 10, delete "second tapering section" and insert -- lower ridge --; lines 4 and 16, before the word "ridge" insert -- upper -- at each occurrence; line 15, delete "the radius of curvature of", after "cavity" insert -- having a radius of curvature of --, and delete "is"; and line 17, delete "the vertical height of the geometric center of", after "cavity" insert -- having geometric center having a vertical height of --, and delete "is".

Column 6,
Line 20, delete "1" and insert -- 2 --; line 27, delete "first tapering section" and insert -- upper ridge --; line 28, delete "second tapering section" and insert -- lower ridge --; lines 29 and 32, before the word "ridge" insert -- upper -- at each occurrence; line 37, delete "the radius curvature of", after "cavity" insert -- having a radius of curvature of --, and delete "is"; and line 38, delete "the vertical height of the geometric center of", after "cavity" insert -- having geometric center having a vertical height of --, and delete "is".

Signed and Sealed this

Fourteenth Day of December, 2004

JON W. DUDAS
*Director of the United States Patent and Trademark Office*